United States Patent [19]

Moriyama

[11] Patent Number: 4,879,938

[45] Date of Patent: Nov. 14, 1989

[54] CASSETTE MUSIC BOX

[75] Inventor: Yasuyuki Moriyama, Nagareyama, Japan

[73] Assignee: Takara Co., Ltd., Tokyo, Japan

[21] Appl. No.: 308,682

[22] Filed: Feb. 9, 1989

[30] Foreign Application Priority Data

Apr. 30, 1988 [JP] Japan ..... 63-58590[U]

[51] Int. Cl.[4] ..... G10F 1/06

[52] U.S. Cl. ..... 84/95.2

[58] Field of Search ..... 84/94.1, 94.2, 95.1, 84/95.2, 97; 446/397, 404, 408

[56] References Cited

U.S. PATENT DOCUMENTS 2,552,288 5/1951 Lee ..... 84/95.2

3,850,070 11/1974 Laurent ..... 84/95.1

*Primary Examiner*—L. T. Hix

*Assistant Examiner*—Brian W. Brown

*Attorney, Agent, or Firm*—Price, Gess & Ubell

[57] ABSTRACT

A cassette music box capable of impressing one as if a cassette tape were operated to play a music recorded on a tape element. The cassette music box includes reels arranged in a casing a manner like in a cassette tape and in a manner to be observed through the casing from its exterior. The reels are rotated in synchronism with rotation of a drum during performance of the music box. The cassette music box may be so constructed so that it may be charged in a cassette operating unit for its performance.

10 Claims, 4 Drawing Sheets

CASSETTE MUSIC BOX

BACKGROUND OF THE INVENTION

1. Field of the Invention

This invention relates to a cassette orgel or music box, and more particularly to cassette music box having a music box body received in a casing like that for a cassette tape.

2. Description of the Prior Art

In general, a conventional music box is so constructed that a music box body including a scale plate, a drum provided with projections and a drum rotating section is received in a casing of a simple shape such as a rectangular shape or a casing having an outer configuration like a piano or the like. Such a casing used for the conventional music box has a fixed appearance free of any movable portion. This renders the conventional music box highly commonplace to a degree that when a music is heard, an appearance of the casing causes everyone to readily recognize that the music box plays it. Thus, the conventional music box fails to exhibit attraction sufficient to excite consumers' interest.

Also, the conventional music box is operated in such a manner that the rotating drum is rotated manually or through a spiral spring wound up manually via a winding-up member. This causes a structure for rotating the drum to be placed under restriction to a degree sufficient to prevent application of any variation to a configuration of the casing and a manner of rotating the drum.

Accordingly, it would be highly desirable to provide a music box which is capable of exhibiting quite an original property and unique configuration sufficient to increase consumers' interest.

SUMMARY OF THE INVENTION

Generally speaking, in accordance with the present invention, a cassette music box is provided. The cassette music box includes a casing having an inner space defined therein, in which a pair of reels are arranged in a manner to be rotatable and spaced from each other. The casing is formed in a manner to permit rotation of the reels to be observed from an exterior of the casing. The cassette music box also includes a music box body arranged in the casing and including a rotating drum and a scale plate operatively engaged with the rotating drum, as well as a transmission mechanism for transmitting driving force between the reels and the music box body.

In the present invention constructed described above, rotation of the drum for performance causes concurrent rotation of the reels, whereas rotation of the reels by external force leads to concurrent rotation of the drum for performance. Also, rotation of the reels are observed through the casing from the exterior. Accordingly, the cassette music box of the present invention can permit one to be impressed as if a cassette tape were operated to play a music recorded on a tape element.

The cassette music box of the present invention may further include a drum drive mechanism for rotating the drum for performance.

The cassette music box of the present invention may be so constructed that the casing is constructed into a configuration sufficient to permit the cassette music box to be charged in a cassette operating unit such as a cassette tape reproducing unit and the reels are construction into a configuration sufficient to be operatively fitted on drive shafts of the cassette operating unit to receive rotational force of the drive shafts when the cassette music box is charged therein. Such construction permits the cassette music box to play music through the reels when it is charged in the cassette operating unit.

Further, the cassette music box of the present invention may be constructed in such a manner that the casing is constructed into a configuration sufficient to permit the cassette music box to be charged in a cassette operating unit, the reels are constructed into a configuration sufficient to be operatively fitted on drive shafts of the cassette operating unit to receive rotational force of the drive shafts when the cassette music box is charged therein, the music box body includes a drum drive mechanism for rotating the drum for performance, and the drum drive mechanism and drum are selectively connected to each other through a selective connection means for carrying out connection between the drum drive mechanism and the drum when the drum drive mechanism is actuated for performance of the music box body and interrupting the connection when the reels are actuated for the performance.

Accordingly, it is an object of the present invention to provide a cassette music box which is capable of exhibiting quite an original and unique interest.

It is another object of the present invention to provide a cassette music box which is capable of impressing one as if a cassette tape were operated to play a music recorded on a tape element.

It is a further object of the present invention to provide a cassette music box which is capable of being operated both manually and automatically.

It is still another object of the present invention to provide a cassette music box which is capable of being charged in a cassette operating unit such as a cassette tape recording unit for performance.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout; wherein.

DETAILED DESCRIPTION OF THE PREFERRED EMBODIMENT

Now, a cassette music box according to the present invention will be described hereinafter with reference to the accompanying drawings.

Figure 1:
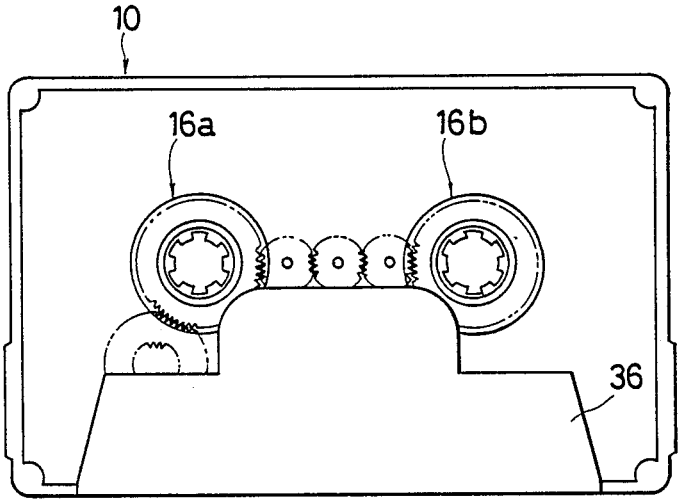
FIG. 1 is a plan view showing an embodiment of a cassette music box according to the present invention.
Figure 2:
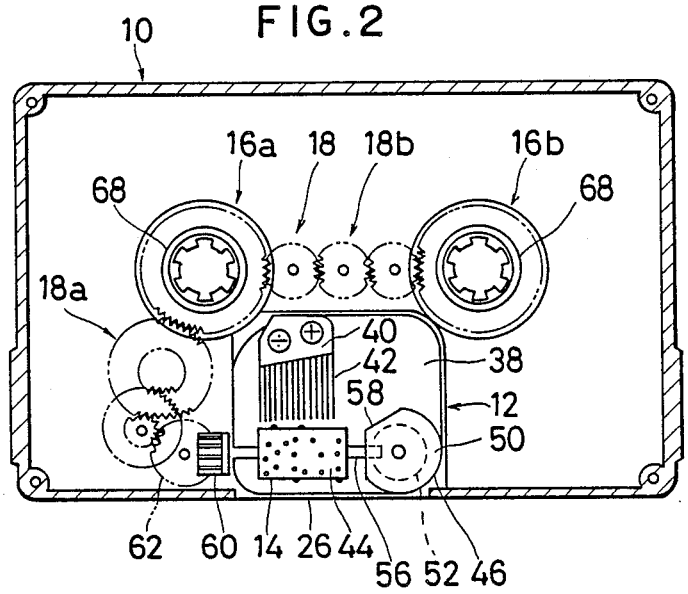
FIG. 2 is a cross sectional view of the cassette music box shown in FIG. 1.
Figure 3:
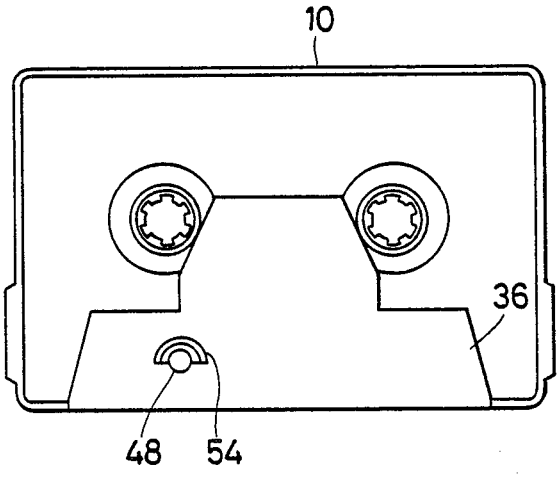
FIG. 3 is a bottom view of the cassette music box shown in FIG. 1.
Figure 4:
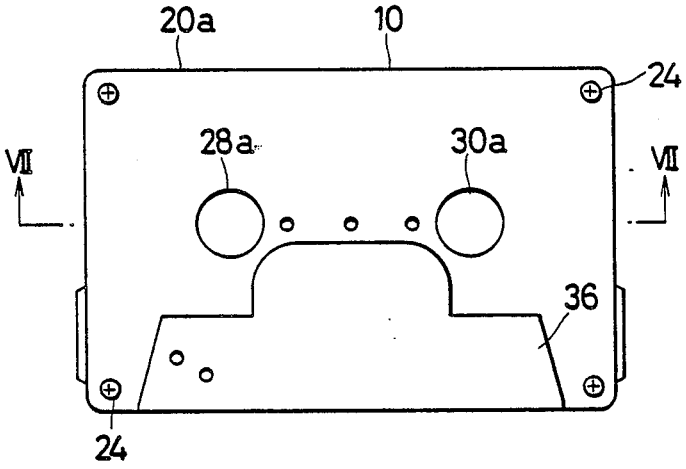
FIG. 4 is a plan view showing a casing for a cassette music box according to the present invention.
Figure 5:
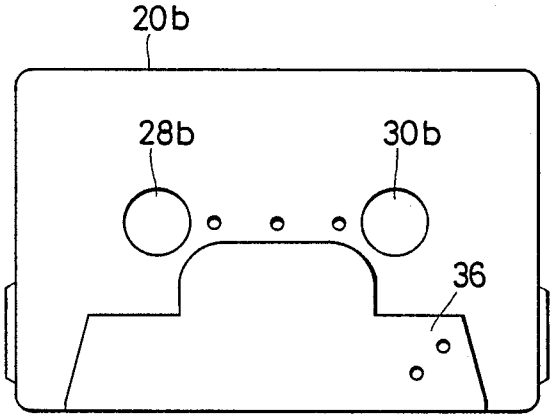
FIG. 5 is a bottom view of the casing shown in FIG. 4.
Figure 6:
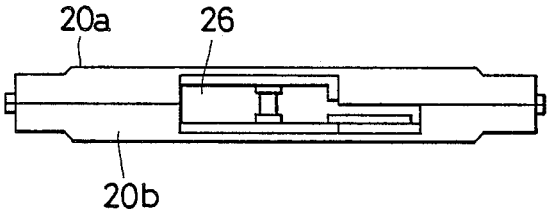
FIG. 6 is a front elevation view of the casing shown in FIG. 4.
Figure 7:
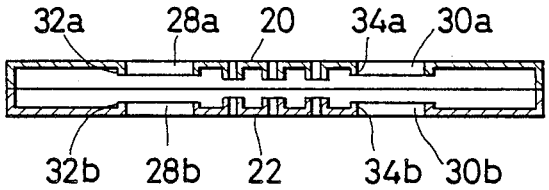
FIG. 7 is a sectional view taken along line VII—VII of FIG. 4.

FIGS. 1 to 3 illustrate an embodiment of a cassete music box according to the present invention. A cassette music box of the illustrated embodiment generally includes a casing 10, a music box body 12 which is arranged in the casing 10 and of which a part is constituted by a rotating drum 14 provided thereon with projection as described hereinafter, a pair of reels 16*a* and 16*b* rotatably arranged in the casing 10, and a transmission mechanism 18 arranged in the casing 10 for carrying out transmission of driving force between the music box body 12 and the reels 16*a* and 16*b* therethrough. In the illustrated embodiment, the music box body 12 may be small-sized and the transmission mechanism 18 comprises a first transmission section 18*a* and a second transmission section 18*b*.

The casing 10 may be formed into a shape like that used for an audio cassette tape, a video cassette tape or the like, as shown in FIGS. 4 to 7. More particularly, it may be constituted by an upper casing member 20*a* and a lower casing member 20*b* formed into a flat rectangular shape and in a manner to be substantially symmetric with respect to each other. For this purpose, the upper and lower casing members 20*a* and 20*b* are joined together using fastening means 24 such as screws to define an inner space therein while being abutted at their peripheral portions against each other, resulting in the casing 10. The casing 10 is provided with an opening 26 on one side surface thereof or at a portion thereof corresponding to a magnetic head inserting opening of a cassette tape or the like. The upper casing member 20*a* is formed with a pair of holes 28*a* and 30*a* in a manner to be laterally spaced from each other and the lower casing member 20*b* is likewise formed with a pair of holes 28*b* and 30*b* in a manner to positionally correspond to or be aligned with the holes 28*a* and 30*a* of the upper casing member 20*a*, respectively. The holes 28*a*, 28*b*, 30*a* and 30*b* are formed on their peripheries thereof with projections 32*a*, 32*b*, 34*a* and 34*b* inwardly extending therefrom, which constitute bearings in cooperation with the corresponding openings.

In the so-constructed casing 10, arrangement of the reels 16*a* and 16*b* in the casing 10 is carried out so that they may be observed from an exterior of the casing. For this purpose, at least the upper casing member 20*a* may be formed of a transparent material such as a transparent plastic material. Alternatively, they may be viewed through the holes 28*a*–30*b*.

The music box body 12 is positioned or mounted in proximity to the opening 26 in the casing 10. The music box body 12 is preferably constructed so that it may not be viewed from the exterior of the casing. For this purpose, a portion 36 of the casing 10 surrounding the music box body 12 may be opaquely constructed. This may be attained by forming the portion 36 of the casing from an opaque material or opaquely coloring the portion 36.

The music box body 12 is constructed into a small size sufficient to be received in the flat casing 10. It includes, in addition to the rotating drum 14, a metal sheet 38 and a scale plate 40 of a pectinate-like configuration mounted on the metal sheet 38 and provided with a plurality of vibration elements 42, as shown in FIG. 2. The rotating drum 14 is rotatably positioned in close proximity to a free end of the scale plate 40 and provided on an outer periphery thereof with a plurality of small projections 44 engaged with the vibration elements 42 for operating them.

In the illustrated embodiment, the music box body 12 further includes a drum drive mechanism 46. The drum drive mechanism 46 may be constructed in a clock-work manner and include a winding-up shaft 48 arranged so as to extend to the exterior of the casing as shown in FIG. 3, a box 50 for receiving therein a spiral spring (not shown) having an inner end coupled with the winding-up shaft 48 and a crown gear 52 (FIG. 2) fixed on the winding-up shaft 48. The spiral spring is wound up by rotating a handle 54 pivotally mounted on a distal end of the winding-up shaft 48 as shown in FIG. 3. When the handle 54 is released after the spiral spring is wound up through the handle, energy stored in the spiral spring is discharged to rotate the crown gear 52. The crown gear 52 is engaged with a pinion 58 fixed on one end of a rotating shaft 56 of the drum 14.

The above-described reels 16*a* and 16*b* are rotatably held in the projections or bearings 32*a* and 32*b* and projections or bearings 34*a* and 34*b*, respectively.

The rotating shaft 56 of the drum 14 is arranged so as to extend outwardly from both side of the drum in its axial direction. The rotating shaft 56 is provided at the other end thereof with another pinion 60. The above-described first and second transmission sections 18*a* and 18*b* of the transmission mechanism 18 are arranged between the pinion 60 and the first reel 16*a* and between the first reel 16*a* and the second reel 16*b*, respectively. The transmission sections 18*a* and 18*b* each include a plurality of gears engaged with one another in order. A first one 62 of the gears constituting the first transmission section 18*a* is a crown gear (not shown) engaged with the pinion 60 of the music box body 12.

Thus, when the drum 14 is rotated through the drum drive mechanism 46, the first and second reels 16*a* and 16*b* are likewise rotated through the first and second transmission sections 18*a* and 18*b* operatively connected to the drum 14, respectively.

More particularly, when rotational energy is stored in the spiral spring through operation of the handle 54 and then the handle 54 of the mechanism 46 is released, the drum 14 is rotated to vibrate the scale plate 40 of the music box body 12 through engagement between the small projections 44 and the vibration elements 42, resulting in playing a music, and simultaneously the reels 16*a* and 16*b* are rotated. The sounds generated from the music box body 12 are amplified by the casing 10.

Thus, it will be noted that the music box of the illustrated embodiment permits one to be impressed as if a music were played by operation of a cassette tape, resulting in quite an original player.

Figure 8:
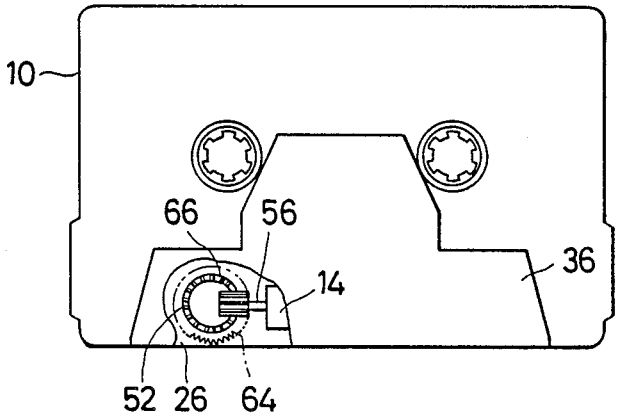
FIG. 8 is a partly broken bottom view showing a variation of a drum drive mechanism which may be incorporated in a cassette music box according to the present invention.

In the illustrated embodiment described above, the drum drive mechanism comprises the clock-work drive mechanism. However, it may be modified in such a manner as shown in FIG. 8. More particularly, in a cassette music box shown in FIG. 8, a drum drive mechanism 46 includes a knurled disc 64 fixed on a crown gear 52. The knurled disc 64 is rotatably mounted on a casing 10 so as to face an opening 26 and the crown gear 52 is engaged with a pinion 66 mounted on a rotating shaft 56 of a drum 14. Such construction permits the knurled disc 64 to be manually rotated, resulting in rotating the drum 14.

The embodiment described above is so constructed that rotation of the drum 14 is transmitted through the transmission sections 18*a* and 18*b* of the transmission means 18 to the reels 16*a* and 16*b*, resulting in the reels being rotated in synchronism with rotation of the drum. Such construction needs to manually operate the handle 54 or knurled disc 64 of the drum drive mechanism 46 for performance of the cassette music box.

The cassette music box of the illustrated embodiment may be modified in a manner such that it may be charged in a cassette operating unit such as a cassette tape reproducing unit or the like for its automatic performance. For this purpose, the reels 16*a* and 16*b* each may be formed on an inside thereof with a boss 68, as shown in FIG. 2. The boss 68 is provided with a plurality of projections and depressions in a manner to be alternately arranged as in an audio cassette tape, so that the reels may be operatively fitted on drive shafts of the cassette operating unit to cause drive force of the rotating force to be transmitted to the reels. When the cassette music box constructed in this way is charged in the cassette operating unit for operation, the drive shafts of the unit rotatably drive the reels 16*a* and 6*b* to rotate the drum 14 through the transmission sections 18*a* and 18*b*, resulting in operating the scale plate 40.

Thus, the cassette music box carries out automatic performance. Accordingly, in the modification, the drum drive mechanism 46 and knurled disc 64 are eliminated from the music box body. The remaining part may be constructed in substantially the same manner as the embodiment described above.

Charging of the so-modified cassette music box in the cassette operating unit permits one to be impressed as if a cassette tape were subjected to a reproducing operation to play a music recorded on a tape element.

Figure 9:
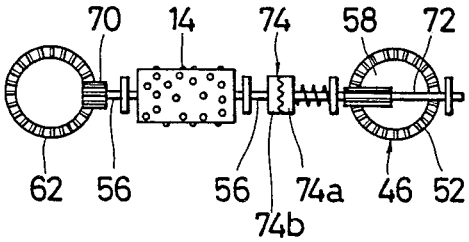
FIG. 9 is a plan view showing an essential part of another embodiment of a cassette music box according to the present invention.

FIG. 9 shows an essential part of another embodiment of a cassette music box according to the present invention. A cassette music box of the illustrated embodiment is adapted to carry out both manual performance and automatic performance.

More particularly, in the cassette music box, a rotating shaft 56 of a drum 14 is provided at one end thereof with a pinion 70 engaged with a crown gear 62 arranged at an end of a first transmission section (not shown) and provided at the other end thereof with a clock-work drum drive mechanism 46. The mechanism 46 includes a crown gear 52 and a pinion 58 engaged with the crown gear 52. The pinion 58 is fixedly mounted on a revolving shaft 72 of the mechanism 46.

The cassette music box of the illustrated embodiment also includes selective connection means 74 arranged between the revolving shaft 72 of the clock-work drum drive mechanism 46 and the rotating shaft 56 of the drum 14. The selective connection means 74 is so constructed that when rotational energy is to be applied to the drum 14 through the clock-work drum drive mechanism 46, the selective connection means 74 operatively connects the drum drive mechanism 46 therethrough to the drum 14, so that the drum drive mechanism 46 is further connected through first and second transmission sections (not shown) to reels (not shown); whereas when the reels are to be driven by, for example, drive shafts of a cassette operating unit, the selective connection means 74 interrupts connection between the drum 14 and the drum drive mechanism 46 to cause driving force of the reels 16*a* and/or 16*b* to be transmitted to only the drum 14, resulting in the mechanism 46 being not actuated. The first and second transmission sections and reels may be constructed in substantially the same manner as the sections 18*a* and 18*b* and reels 16*a* and 16*b* in the above-described embodiment.

The selective connection means 74 exhibiting the above-described function, as shown in FIG. 9, may comprise a pair of surface gears 74*a* and 74*b* which are adapted to be engaged with each other when being rotated in one direction and separated from each other when being rotated in the other direction. It may comprise a one-way clutch.

Alternatively, the selective connection means 74 may comprise a connection element provided at one of the rotating shaft 56 of the drum 14 and the revolving shaft 72 of the drum drive mechanism 46 and constructed in a manner to be axially movable and engaged with the other shaft when it is moved toward the other shaft to rotate both shafts together.

The remaining part of the embodiment shown in FIG. 9 may be constructed in substantially the same manner as the embodiment described above.

Thus, it will be noted that the embodiment of FIG. 9 constructed as described above causes a changing-over operation of the selective connection means 74 to not only manually carry out performance of the cassette music box through the clock-work drum drive mechanism 46 while rotating the reels 16*a* and 16*b* but automatically accomplish it through the reels 16*a* and 16*b* when it is charged in a cassette operating unit.

In each of the embodiments described above, the transmission means 18 comprises a series of gears. However, it may comprise another suitable transmission element such as a string, a chain, a belt or the like.

As can be seen from the foregoing, the cassette music box of the present invention is so constructed that the rotation of reels is carried out in synchronism with that of the drum and the reels are arranged in a manner to be observed through the casing from the exterior, accordingly, the present invention permits one to be impressed as if a cassette tape were operated to play a music recorded on a tape element. Also, the cassette music box of the present invention may be so constructed that it is charged in a cassette operating unit such as a cassette tape reproducing unit for its performance. Thus, it will be noted that the present invention provides quite an original cassette music box.

It will thus be seen from the foregoing, the objects set forth above, among those made apparent from the preceding description, are efficiently attained and, since certain changes may be made in the above description without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A cassette music box comprising:

a casing having an inner space defined therein;

a pair of reels arranged in said casing in a manner to be rotatable and spaced from each other;

said casing being formed in a manner to permit rotation of said reels to be observed from an exterior of said casing;

a music box body arranged in said casing and including a rotating drum and a scale plate operatively engaged with said rotating drum; and a transmission mechanism for transmitting driving force between said reels and said music box body.

2. A cassette music box as defined in claim 1, wherein said casing is transparently formed at a portion thereof at which said reels are arranged.

3. A cassette music box as defined in claim 1, wherein said casing is opaquely formed at a portion thereof surrounding said music box body.

4. A cassette music box as defined in claim 1, said music box body further includes a drum drive mechanism for rotating said drum for performance.

5. A cassette music box as defined inclaim 4, wherein said drum drive mechanism is a clock-work type and manually operated.

6. A cassette music box as defined in claim 1, wherein said casing is constructed into a configuration sufficient to permit said cassette music box to be charged in a cassette operating unit; and said reels are constructed into a configuration sufficient to be operatively fitted on drive shafts of said cassette operating unit to receive rotational force of said drive shafts when said cassette music box is charged therein.

7. A cassette music box as defined in claim 1, wherein said music box body further includes a drum drive mechanism for rotating said drum for performance;

said casing being constructed into a configuration sufficient to permit said cassette music box to be charged in a cassette operating unit;

said reels being constructed into a configuration sufficient to be operatively fitted on drive shafts of said cassette operating unit to receive rotational force of said drive shafts when said cassette music box is charged therein;

said drum drive mechanism and drum being connected through a selective connection means for selectively operatively connecting said drum drive mechanism and drum to each other;

said selective connection means carrying out connection between said drum drive mechanism and said drum when said drum drive mechanism is actuated for performance of said music box body and interrupting said connection when said reels are actuated for said performance.

8. A cassette music box comprising:

a casing having an inner space defined therein;

a pair of reels arranged in said casing in a manner to be rotatable and spaced from each other;

said casing being formed in a manner to permit rotation of said reels to be observed from an exterior of said casing;

a music box body arranged in said casing and including a rotating drum, a scale plate operatively engaged with said rotating drum and a drum drive mechanism for rotating said drum for performance; and a transmission mechanism for transmitting driving force between said reels and said music box body.

9. A cassette music box comprising:

a casing having an inner space defined therein;

a pair of reels arranged in said casing in a manner to be rotatable and spaced from each other;

said casing being formed in a manner to permit rotation of said reels to be observed from an exterior of said casing;

said casing being constructed into a configuration sufficient to permit said cassette music box to be charged in a cassette operating unit;

said reels being constructed into a configuration sufficient to be operatively fitted on drive shafts of said cassette operating unit to receive rotational force of said drive shafts when said cassette music box is charged therein;

a music box body arranged in said casing and including a rotating drum and a scale plate operatively engaged with said rotating drum; and a transmission mechanism for transmitting driving force between said reels and said music box body.

10. A cassette music box comprising:

a casing having an inner space defined therein;

a pair of reels arranged in said casing in a manner to be rotatable and spaced from each other;

said casing being formed in a manner to permit rotation of said reels to be observed from an exterior of said casing;

said casing being constructed into a configuration sufficient to permit said cassette music box to be charged in a cassette operating unit;

said reels each being constructed into a configuration sufficient to be operatively fitted on drive shafts of said cassette operating unit to receive rotational force of said drive shafts when said cassette music box is charged therein;

a music box body arranged in said casing and including a rotating drum, a scale plate operatively engaged with said rotating drum and a drum drive mechanism for rotating said drum for performance; and a transmission mechanism for transmitting driving force between said reels and said music box body;

a selective connection means for selectively connecting said drum drive mechanism and drum to each other;

said selective connection means carrying out connection between said drum drive mechanism and said drum when said drum drive mechanism is actuated for performance of said music box body and interrupting said connection when said reels are actuated for said performance.

* * * * *